US005205009A

United States Patent [19]

Cottino et al.

[11] Patent Number: 5,205,009

[45] Date of Patent: Apr. 27, 1993

[54] SHOE SUPPORT

[75] Inventors: Giovanni Cottino, Vigevano, Italy; Terence J. Brown, Wigston; Alfred R. Corbett, Birstall, both of England; Alan Thompson, Bangkok, Thailand

[73] Assignee: British United Shoe Machine Ltd., Leicester, England

[21] Appl. No.: 876,488

[22] Filed: Apr. 30, 1992

[30] Foreign Application Priority Data

May 3, 1991 [GB] United Kingdom ..... 9109652.9
Mar. 19, 1992 [GB] United Kingdom ..... 9206116.7

[51] Int. Cl.[5] ..... A43D 25/20; B65G 17/32

[52] U.S. Cl. ..... 12/1 A; 12/33.2; 12/124; 198/803.11

[58] Field of Search ..... 12/1 A, 1 R, 33.2, 123, 12/124; 198/473.1, 803.11

[56] References Cited

U.S. PATENT DOCUMENTS 2,432,024 12/1947 Lipton ..... 198/803.11
2,690,136 9/1954 Freeman ..... 12/1 A
3,056,984 10/1962 Snitzer ..... 12/142
3,533,117 10/1970 Dinolfo et al. ..... 12/1 A

FOREIGN PATENT DOCUMENTS 0136784 4/1985 European Pat. Off. .
0296329 12/1988 European Pat. Off. .
0328923 8/1989 European Pat. Off. .
855371 11/1952 Fed. Rep. of Germany .

*Primary Examiner*—Steven N. Meyers
*Assistant Examiner*—M. D. Patterson

[57] ABSTRACT

A shoe support for supporting lasts of a wide range of sizes comprises two support members in the form of spaced-apart bars (38) each of which can pivot at an axis (36) extending adjacent an elongated edge of its associated bar so that the distance between the ends of the bars can be varied. Instead of bars (38), plate members (138) may be used, dimensioned so as to provide a substantially continuous support surface, for e.g. shoe components, when pivoted to a horizontal position. For maintaining the support members (38;138) in adjusted position, furthermore, a friction arrangement (40,42; 144,146) is provided. The shoe support is especially suitable for use in a shoe transporter system forming part of a drying apparatus in which the bottoms of shoes and/or shoe components to which a coating of e.g. adhesive has been applied can be supported by the shoe supports with the coated surfaces exposed to turbulent air and heat.

12 Claims, 5 Drawing Sheets

SHOE SUPPORT

BACKGROUND OF THE INVENTION

This invention is concerned with a shoe support for supporting a lasted shoe, bottom up, comprising a pair of support members spaced apart from one another and each extending in a direction lengthwise of a shoe to be supported thereby such that the cone of a last can be received between the support members and the shoe is supported by shoe-supporting surface portions of the members with the shoe bottom exposed. Such a shoe support is particularly useful e.g. for supporting a shoe to the bottom of which adhesive has been applied, for the purpose of enabling the coating of adhesive to dry or be subjected to a drying operation.

A problem arises in the case of such shoe supports in that it is desirable that each such support be adjustable in order to accommodate shoes of a wide range of sizes, from a large man's shoe to a small infant's shoe. Proposals have been made for accommodating such a range, but these may often require the operator to release a locking arrangement, reposition the support members appropriately and then relock them, which is time-consuming and tedious, especially in the case of support members which are in use in a drying apparatus which must be able readily to accept shoes from different parts of a shoe factory and of a wide range of sizes.

OBJECTS OF THE INVENTION

It is thus one of the various objects of the present invention to provide an improved shoe support in which the support members can more readily be adjusted to accommodate a given shoe.

SUMMARY OF THE INVENTION

This object is resolved in accordance with the present invention in that, for adjusting the spacing between the shoe-supporting surface portions of the support members to accommodate shoes of different sizes, each member is mounted for pivotal movement about an axis disposed adjacent an elongated edge thereof, a friction arrangement being provided for maintaining the members in adjusted position. It will thus be appreciated that with such an arrangement, the operator can readily move the support members to a new position, in which they will then be maintained, for any shoe to be correctly supported thereby. In particular when shoe supports of this type are used in e.g. a drying apparatus, the facility for such a quick adjustment of the positions of the members is considered to be advantageous.

In one embodiment of the invention each support member is supported by a shaft which is mounted for rotational movement in a carrier, the friction arrangement comprising a friction plug held in the carrier and engaging a surface of the shaft. A relatively simple arrangement is thus provided for facilitating the adjustment of the support members and their maintenance in adjusted position.

In said one embodiment, furthermore each support member is in the form of a hollow bar of generally oval cross-section. Such a support member has been found very suitable for use in supporting lasted shoes.

Where, however, the shoe supports of the invention are used in drying adhesive applied to lasted shoe bottoms prior to the attachment to such bottoms of a sole unit to which also an adhesive coating has been applied, it would be convenient if the sole unit could be subjected to drying at the same time as the shoe bottom so that both shoe end sole units are made ready at the same time for attachment together.

In another embodiment of the invention, therefore, each support member is in the form of a plate member so dimensioned that when the plate members are pivoted about said axis to bring the shoe-supporting surface portions thereof into a common plane said surface portions form a substantially continuous surface on which e.g. a sole unit can be supported.

Preferably a plurality of shoe supports in accordance with the invention will together form part of a shoe transporter system, said shoe supports being mounted adjacent one another on a continuous drive arrangement and being carried successively from a loading station to an unloading station. To this end, conveniently the drive arrangement is of the linear type, the loading and unloading stations being located at opposite ends of one reach, e.g. the upper reach, of the linear drive arrangement. The shoe supports can then be returned to the loading station a long the other reach of said drive arrangement.

Moreover, where the shoe supports each comprise a pair of plate members preferably adjacent plate members forming part of adjacent shoe supports are mounted for pivotal movement about a common axis. In this way there is a significant space saving, leading to the ability to move a greater number of shoes and/or shoe components for a given distance between the loading and unloading stations than in the case where each support member is mounted singly on an axis of pivot.

Using such a shoe transporter system has been found to be particularly appropriate in a drying apparatus comprising a drying chamber through which shoes can be carried using the system and in which jets of air are directed against the exposed bottoms of shoes supported by said system and said bottoms are heated. In one particular embodiment, furthermore, such a shoe transporter system, using shoe supports each comprising a pair of bar members as described above, may be used in combination with a further continuous drive arrangement comprising platform portions on which shoe sole units can be supported and carried through a further drying chamber in timed relation with the operation of the drive arrangement of said shoe transporter system, in which further drying chamber again jets of air are directed against exposed portions of units supported by said platforms and said portions of the units are heated.

Alternatively, in another embodiment the shoe supports may each comprise a pair of plate members as described above, in which case both shoes and shoe components may be supported for passage through the same drying chamber, according to the disposition of the plate members of each shoe support.

Other aspects of the present invention will be set out as appended claims 7, 11 and 12.

There now follows a detailed description, to be read with reference to the accompanying drawings, of two shoe supports in accordance with the invention and also two drying apparatuses each comprising a shoe transporter system which incorporates shoe supports in accordance with the invention. It will of course be appreciated that these shoe supports, systems and apparatuses have been selected for description merely by way of nonlimiting examples of the invention.

DESCRIPTION OF THE PREFERRED EMBODIMENTS

Figure 1:
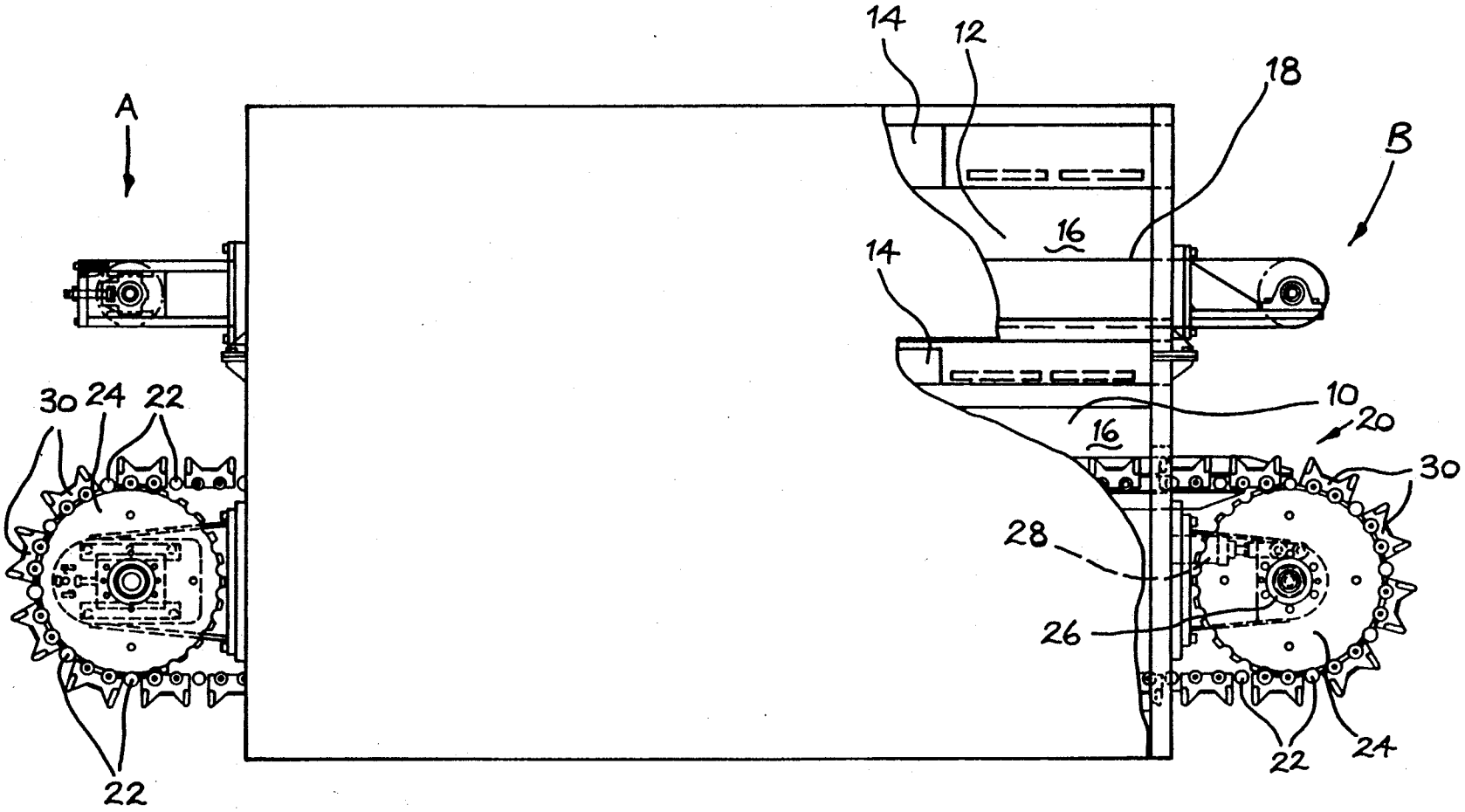
FIG. 1 is a side elevational view, with parts broken away, of a first drying apparatus comprising a plurality of first shoe supports in accordance with the invention.

Viewing FIG. 1, the first drying apparatus comprises two drying chambers 10, 12 arranged one above the other and each comprising a plenum chamber 14 and an infra-red drying station 16. The drying chamber 10 is adapted for drying coatings applied to bottoms of lasted shoes and the drying chamber 12 for drying coatings applied to sole-and-heel units for subsequent attachment to the shoe bottoms. For carrying units through the drying chamber 12, a continuous belt 18 is provided constituting a plurality of platform portions on which units may be supported; alternatively, however, individual platforms carried e.g. by a continuous chain may be provided for this purpose. Whichever system is provided, however, the belt or chain, which constitutes a drive arrangement of said chamber 12, is driven in timed relation with a shoe transporter system generally designated 20 by which shoes are conveyed through the drying chamber 10.

The shoe transporter system 20 comprises a chain 22 entrained about two large sprockets 24 and supporting a plurality of carriers 30 each constituting part of a first shoe support in accordance with the invention. One of the sprockets (the right-hand viewing FIG. 1) is driven through a freewheel arrangement 26 by a piston-and-cylinder arrangement 28, the chain 22 being thus driven intermittently, whereby the shoe supports supported by the upper reach of the chain at any given time are moved from a loading station A at one end to an unloading station B at the other, the shoe supports then being returned along the lower reach back to the loading station A.

Figure 2:
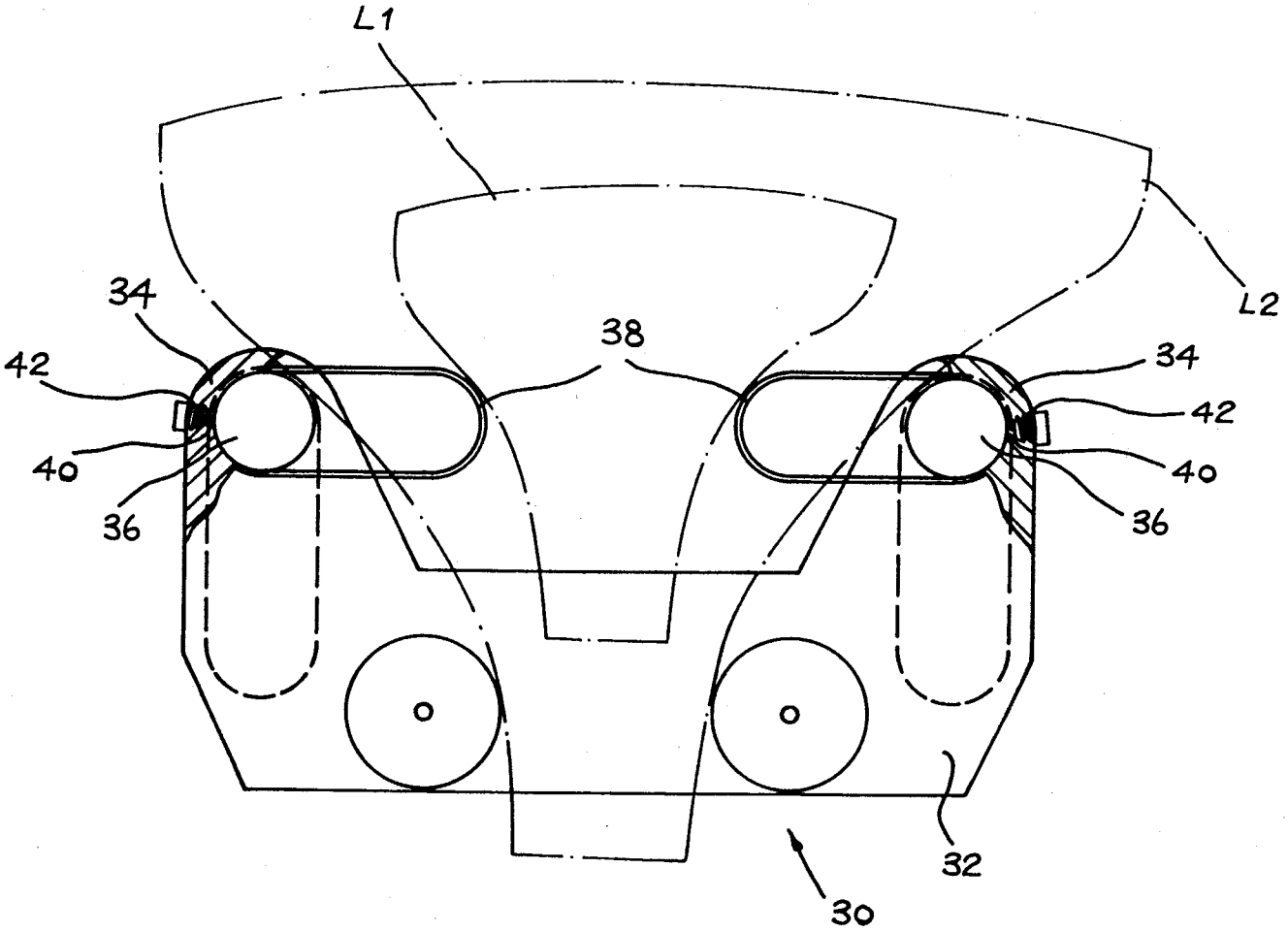
FIG. 2 is a fragmentary view of a first shoe support in accordance with the invention with parts broken away to show details of a support for a bar member constituting part thereof.

Each carrier 30 (see FIG. 2) comprises a casting 32 which is mounted on the chain 22 and which has two upstanding lugs 34. Each lug 34 supports a shaft 36 which projects outwardly from the lug 34 and extends transversely of the drying chamber 10. The shaft 36 can rotate within the lug 34, as will be referred to hereinafter. Secured to each shaft 36 is a support member in the form of a hollow bar 38 of generally oval cross-section and providing a shoe-supporting surface portion of the shoe support. By the rotatability of each shaft 36 in its associated lug 34 its associated bar 38, one elongated edge of which is located on the axis of the shaft 36, can pivot or swing between a vertical positions(shown in chain line in FIG. 2) and a horizontal position (shown in full line in FIG. 2). It will be appreciated that according to the disposition of the bars about the axes of the shafts 36 a larger or smaller gap will be provided between the shoe-supporting surface portions thereof, and thus shoes of different sizes can be supported thereby. FIG. 2 shows , a relatively small last (Ll) supported by the bars in their horizontal position, with the cone of the last projecting downwardly therebetween, and also a substantially larger last (L2) supported by the bars when pivoted to their vertical position.

For maintaining the bars 38 in adjusted position, a plug 40 (FIG. 3), e.g. of nylon, is accommodated in a threaded bore formed in each lug 34 and is engageable with the surface of the shaft 36, a set screw 42 or the like being provided whereby to vary the pressure by which the plug is urged against the shaft surface. In this way the bars 38 may be reliably maintained in their adjusted position and thus support lasts of a wide range of sizes.

When the operator needs to vary the adjusted position he need merely grasp the bars at the loading station and rotate them to a desired new position.

Figure 3:
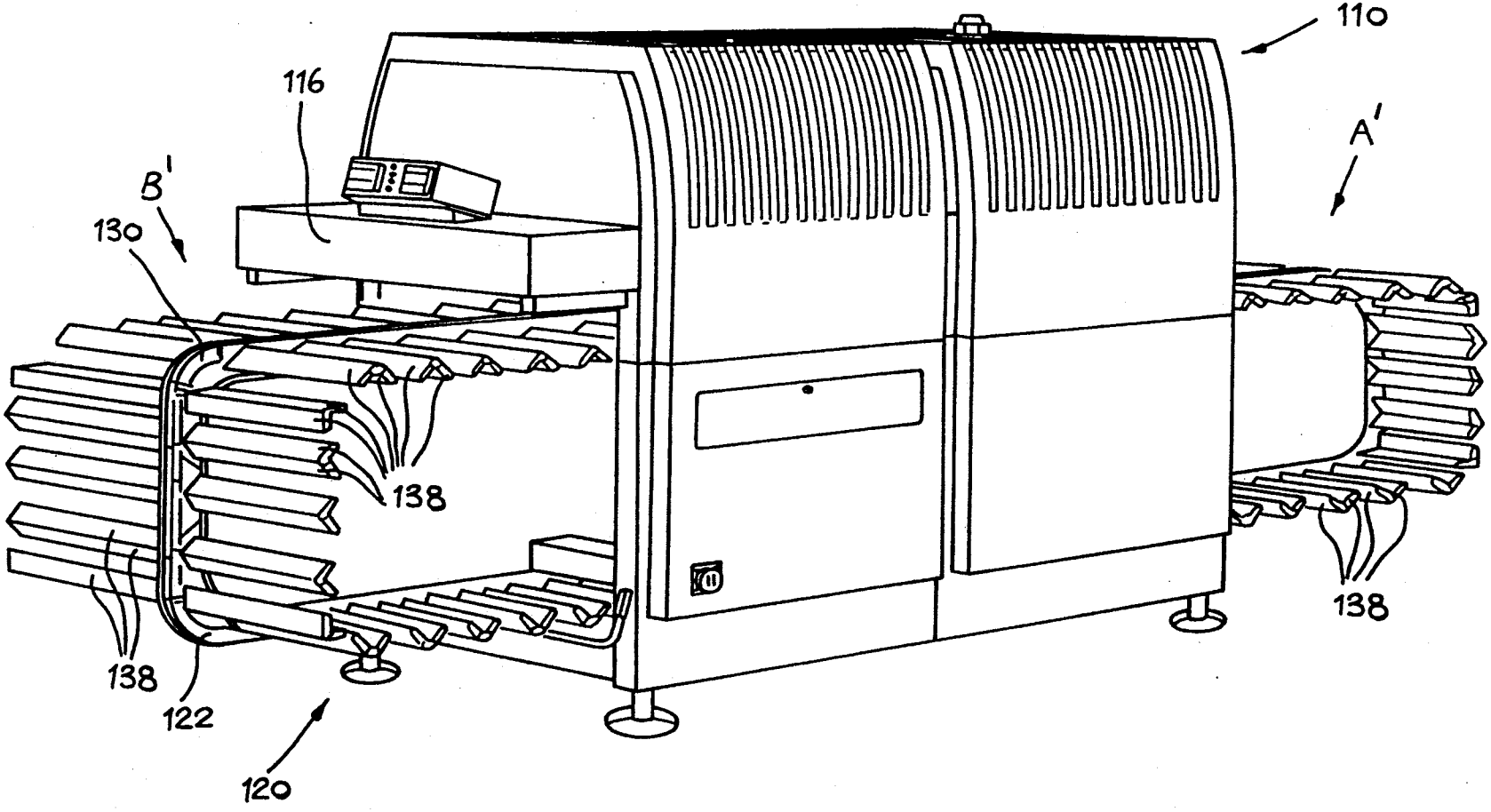
FIG. 3 is a perspective view of a second drying apparatus comprising a plurality of second shoe supports in accordance with the invention.

Turning to FIG. 3, the second drying apparatus comprises a drying chamber 110 comprising a plenum chamber (not shown, but generally as in the first drying apparatus) and an infra-red drying station 116. For carrying units through the drying chamber 110 a shoe transporter system generally designated 120 is provided comprising a chain 122 entrained about a plurality of sprockets and supporting, at each side thereof, a plurality of carriers 130, each one constituting part of a second shoe support in accordance with the invention. One of the sprockets is driven in the same manner as in the case of the first drying apparatus, whereby again the carriers 130 are moved along an upper reach of the chain between a loading station A and unloading station B.

Figure 4:
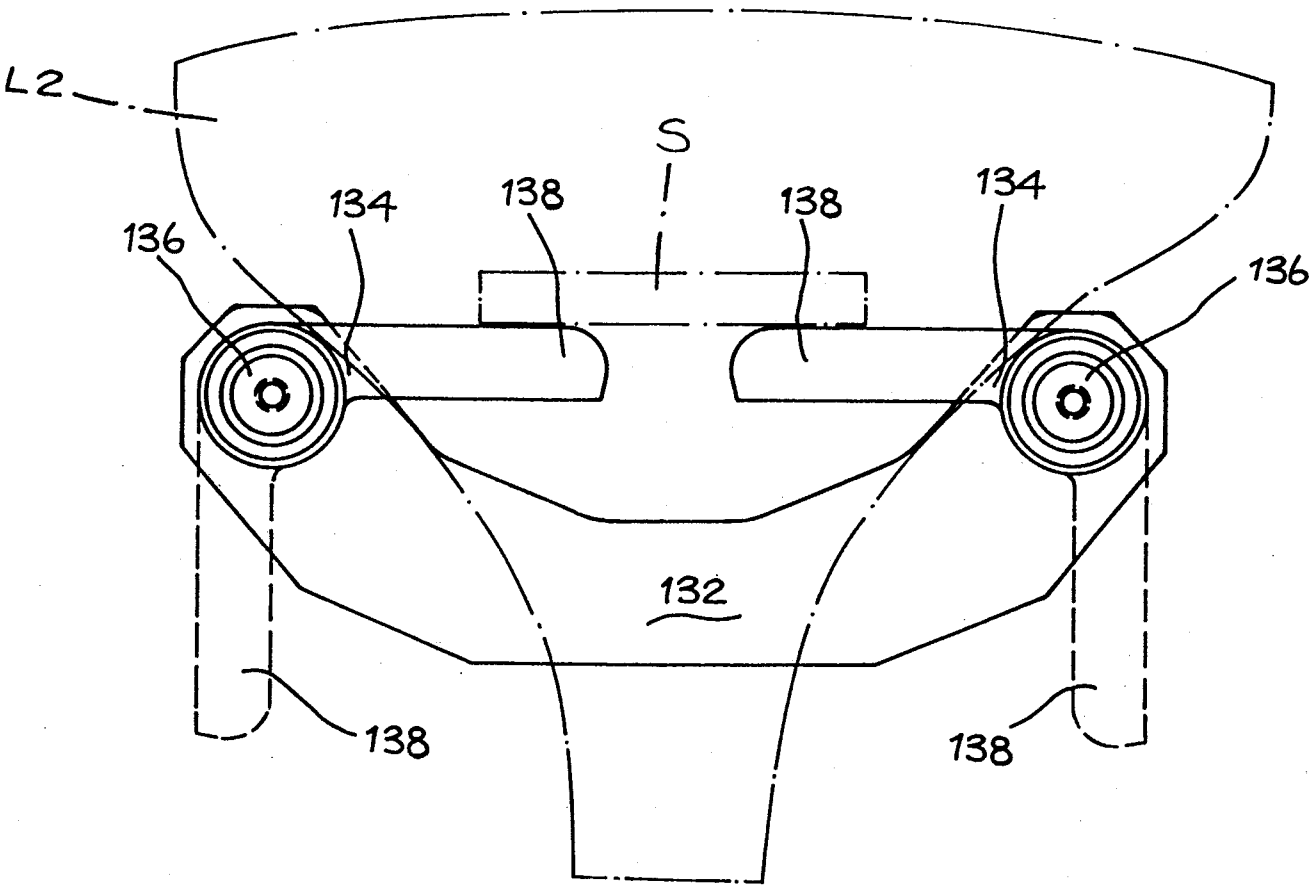
FIG. 4 is a fragmentary view of a second shoe support in accordance with the invention.
Figure 5:
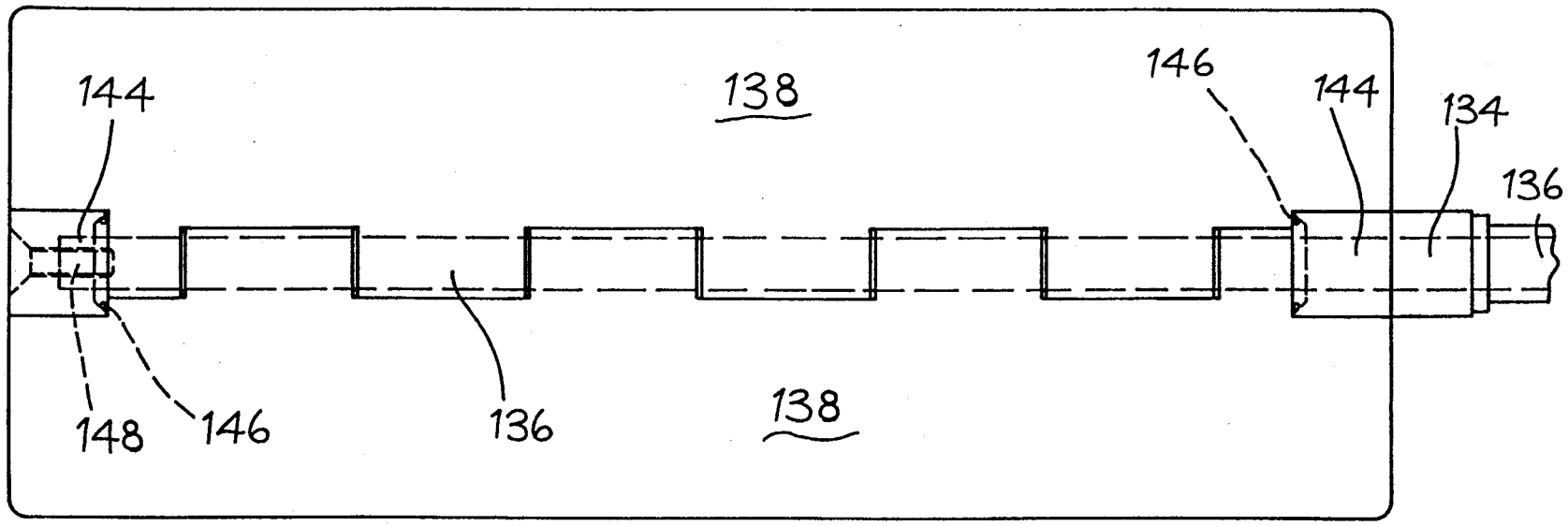
FIG. 5 is a plan view showing two plate members, forming part of adjacent shoe supports, mounted on a common pivot.

Each carrier 130 (FIGS. 4 and 5) comprises a fabricated support 132 which forms part of the chain and which has two upstanding lugs 134. Each lug supports a shaft 136 extending across the width of the drying apparatus, i.e. projecting outwardly at opposite sides of the chain 122, the shafts being fixedly held in their support lugs, as will be referred to hereinafter. Mounted on each of the outwardly projecting portions of each shaft 136, for pivotal movement relative thereto, are two support members in the form of plate members 138, one of said members forming part of one shoe support and the other member forming part of another, adjacent, shoe support. Each plate member thus has, along its elongated edge at which it is mounted on the shaft, castellations whereby it can interlock with the other plate member supported by that shaft. The two plate members can thus pivot about the shaft independently of each other. Each plate member 138 provides a shoe-supporting surface portion between which and a corresponding surface portion provided by the adjacent plate member on the next adjacent shaft 136 a shoe can be supported or alternatively by which together with said corresponding surface portion a shoe component, e.g. a sole unit, can be supported. To this end the plate members 138 can, as mentioned above, be pivoted each about their supporting shaft 136, between a vertical position, in which they can support a large last L2, and a horizontal position in which they present a substantially continuous support surface on which a shoe component (S) can be supported. It will of course be appreciated that the dimensions of the plate members 138 and of the spacing between adjacent shafts 136 is such that a substantially continuous surface is provided when the plate members are lying horizontal. It will also be appreciated that any size of conventionally available last will be able to be accommodated by the surface portions of the plate members 138 by pivoting them to a suitable position intermediate the vertical and horizontal.

As in the case of the first shoe support, the plate members 138 are pivotally mounted as aforesaid for adjusting movement manually by the operator. For maintaining the plate members in adjusted position, moreover, in each shoe support a collar 144 is provided at each end of the shaft 136, i.e. at the outer end of the shaft and also adjacent the chain 122. One of the collars 144 abuts a side face of one of the castellations of one of the plate members mounted on the shaft and the other collar 144 similarly abuts a side face of one of the castellations of the other plate member. Between each collar and its abutting side face is an O-ring made of a deformable material, and each collar has a countersink in which the O-ring is partially accommodated. The collar at the outer end of the shaft 136 has a bore 146 through which the shank of a securing screw 148 passes, while the head of the screw is accommodated in a countersink in the end face of the collar. The screw 148 is threadedly received in a threaded internal bore in the end of the shaft 136. As the screw is screwed into said bore, not only is the collar 144 secured in position, thus preventing the plate members 138 from sliding off the shaft, but furthermore the O-rings are caused to deform and thus to provide a friction grip on said side face of each of the plate members. In this way, the plate members are reliably held against displacement from their adjusted positions.

As in the case of the first shoe support, when the operator needs to vary the adjusted position he need merely grasp the bars at the loading station and rotate them to a desired new position.

We claim:

1. A shoe support for supporting a lasted shoe, bottom up, comprising a pair of support members spaced apart from one another and each extending in a direction lengthwise of a shoe to be supported thereby such that a cone of a last can be received between the support members and the shoe is supported by shoe-supporting surface portions of said members with the shoe bottom exposed, wherein for adjusting the spacing between the shoe-supporting surface portions of the support members to accommodate shoes of different sizes, each member is mounted for pivotal movement about an axis disposed adjacent an elongated edge thereof, a friction arrangement being provided for maintaining the members in adjusted position.

2. A shoe support according to claim 1 wherein each member is supported by a shaft which is mounted for rotational movement in a carrier, and wherein the friction arrangement comprises a friction member which engages a surface of the shaft.

3. A shoe support according to claim 2 wherein each support member is in the form of a hollow bar of generally oval cross-section.

4. A shoe support according to claim 1 wherein each member is supported for rotational movement about a shaft supported by a carrier, and wherein the friction arrangement comprises a collar and O-ring which is mounted on the shaft and urged against an abutment face of the member.

5. A shoe support according to claim 1 wherein each support member is in the form of a plate member so dimensioned that when the plate members are pivoted about said axis to bring the shoe-supporting surface portions thereof into a common plane said surface portions form a substantially continuous surface on which e.g. a sole unit can be supported.

6. A shoe support according to claim 5 wherein each member is supported for rotational movement about a shaft supported by a carrier, and wherein the friction arrangement comprises a collar and O-ring which is mounted on the shaft and urged against an abutment face of the member.

7. A shoe transporter system comprising a plurality of shoe supports, wherein each shoe support comprises a pair of support members spaced apart from one another and extending in a direction lengthwise of a shoe to be supported thereby such that a cone of a last can be received between the support members and the shoe is supported by shoesupporting surface portions of said members with the shoe bottom exposed, each of said members being mounted for pivotal movement about an axis disposed adjacent an elongated edge thereof, and a friction arrangement being provided for maintaining the members in adjusted position, and wherein the shoe supports are mounted adjacent one another on a continuous drive arrangement and are carried successively from a loading station to an unloading station.

8. A system according to claim 7 wherein each support member is in the form of a hollow bar of generally oval cross-section and is supported by a shaft which is mounted for rotational movement in a carrier, and wherein the friction arrangement comprises a friction member which engages a surface of the shaft.

9. A system according to claim 7 wherein each support member is in the form of a plate member so dimensioned that when the plate members are pivoted about said axis to bring the shoe-supporting surface portions thereof into a common plane said surface portions form a substantially continuous surface on which e.g. a sole unit can be supported, and wherein adjacent plate members forming part of adjacent shoe supports are mounted for pivotal movement about a common axis.

10. A system according to claim 7 wherein the drive arrangement is of the linear type.

11. A drying apparatus comprising a drying chamber, and a shoe transporter system for carrying shoes through the drying chamber, wherein the drying chamber comprises means for directing jets of air against the exposed bottoms of shoes supported by said system, wherein the shoe transporter system comprises a plurality of shoe supports, each comprising a pair of support members spaced apart from one another and extending in a direction lengthwise of a shoe to be supported thereby such that a cone of a last can be received between the support members and the shoe is supported by shoesupporting surface portions of said members with the shoe bottom exposed, each of said members being mounted for pivotal movement about an axis disposed adjacent an elongated edge thereof, and a friction arrangement being provided for maintaining the members in adjusted position, the shoe supports being mounted adjacent one another on a continuous drive arrangement and being carried successively from a loading station to an unloading station, and wherein a further continuous drive arrangement is provided comprising platform portions on which shoe sole units can be supported and be carried through a further drying chamber in timed relation with the operation of the first-mentioned drive arrangement, in which further drying chamber jets of air are directed against exposed portions of units supported by said platform portions and said portions of the units are heated.

12. A drying apparatus comprising a drying chamber, and a shoe transporter system for carrying shoes and shoe components through the drying chamber, wherein the drying chamber comprises means for directing Jets of air against an exposed surface to be dried of shoes and shoe components supported by said system, and wherein the shoe transporter system comprises a plurality of shoe supports, each comprising a pair of support members spaced apart from one another and extending in a direction lengthwise of a shoe to be supported thereby such that a cone of a last can be received between the support members and the shoe is supported by shoe-supporting surface portions of said members with the shoe bottom exposed, each of said members being mounted for pivotal movement about an axis disposed adjacent an elongated edge thereof, and a friction arrangement being provided for maintaining the members in adjusted position, the shoe supports being mounted adjacent one another on a continuous drive arrangement and are carried successively from a loading station to an unloading station, and wherein each support member is in the form of a plate member so dimensioned that when the plate members are pivoted about said axis to bring the shoe-supporting surface portions thereof into a common plane said surface portions form a substantially continuous surface on which e.g. a sole unit can be supported, and further wherein adjacent plate members forming part of adjacent shoe supports are mounted for pivotal movement about a common axis.

* * * * *